United States Patent [19]

Nozawa

[11] Patent Number: 4,621,685

[45] Date of Patent: Nov. 11, 1986

[54] HEAT EXCHANGER COMPRISING CONDENSED MOISTURE DRAINAGE MEANS

[75] Inventor: Kazuo Nozawa, Konan, Japan

[73] Assignee: Diesel Kiki Co., Ltd., Tokyo, Japan

[21] Appl. No.: 664,457

[22] Filed: Oct. 24, 1984

[30] Foreign Application Priority Data

Oct. 29, 1983 [JP] Japan ..... 58-168093[U]

[51] Int. Cl.[4] ..... F28B 3/00

[52] U.S. Cl. ..... 165/111; 62/285; 165/153; 165/170; 165/176

[58] Field of Search ..... 165/110, 111, 152, 153, 165/166, 167, 170, 176; 62/285, 288, 289, 290

[56] References Cited

U.S. PATENT DOCUMENTS

| | | | |
|---|---|---|---|
| 3,631,923 | 1/1972 | Izeki | 165/167 |
| 4,081,025 | 3/1978 | Donaldson | 165/153 X |
| 4,180,129 | 12/1979 | Sumitomo | 165/170 X |
| 4,182,411 | 1/1980 | Sumitomo et al. | 165/167 X |
| 4,217,953 | 8/1980 | Sonoda et al. | 165/176 X |
| 4,228,850 | 10/1980 | Sumitomo | 165/170 X |

FOREIGN PATENT DOCUMENTS

| | | | |
|---|---|---|---|
| 1317763 | 1/1963 | France | 165/170 |
| 0214783 | 12/1983 | Japan | 62/285 |
| 0217195 | 12/1983 | Japan | 62/285 |

*Primary Examiner*—Albert W. Davis, Jr.
*Assistant Examiner*—Randolph A. Smith
*Attorney, Agent, or Firm*—David G. Alexander

[57] ABSTRACT

A heat exchanger with a stack of alternating hollow panels and corrugated plates includes a unique arrangement for positive drainage of water which flows down onto lower headers of the hollow panels as a result of condensation of moisture contained in air, which is pumped through the heat exchanger. A substantially vertical drain channel is defined between facing outer surfaces of the lower headers of nearby hollow panels, so that the water is guided downwardly from the upper surfaces of the lower headers into a sump as well as along the sides of the lower headers.

3 Claims, 7 Drawing Figures

HEAT EXCHANGER COMPRISING CONDENSED MOISTURE DRAINAGE MEANS

BACKGROUND OF THE INVENTION

The present invention relates to a heat exchanger such as a laminate evaporator for an air conditioning system of a motor vehicle or the like.

The type of heat exchanger to which the present invention constitutes a novel and advantageous improvement comprises a plurality of generally flat, hollow panels which are stacked together with corrugated plates or the like interspersed therebetween, and end plates applied to both ends of the stacked panel and corrugated plate assembly. Each panel has a bore defined substantially parallel to the general plane of the panel, and a pair of headers opposing each other at the upper end of the panel, and another pair of headers opposing each other at the lower end of the same.

Where the heat exchanger is used as an evaporator, a refrigerant fed into the bores flows through the hollow panels and passes out of the evaporator. Air to be cooled is pumped through the corrugated plates. The refrigerant flowing through the panels absorbs heat from the air, thereby lowering the temperature thereof.

The problem with such a prior art heat exchanger is that water resulting from the condensation of moisture in the air which is being cooled cannot be well drained. That is, the water is apt to remain in the heat exchanger without being collected in a sump below the heat exchanger, due to inherent configuration of the lower headers of the panels. The probability of the water being frozen in the heat exchanger or scattered thereoutof is significant.

Further, the headers of the prior art heat exchanger are insufficient in mechanical strength because their outer surfaces are shaped simply flat.

SUMMARY OF THE INVENTION

It is an object of the present invention to provide a heat exchanger furnished with an arrangement for draining water which is simple, and yet positive.

It is another object of the present invention to provide a heat exchanger having headers which exhibit excellent mechanical strength.

A heat exchanger of the present invention comprises a plurality of hollow panels arranged in a stack with corrugated plates interspersed therebetween and each having a fluid passageway therein and an upper header and a lower header at opposite sides of the fluid passageway, and upper and lower headers being perforated to communicate respectively with upper headers and lower headers of the nearby hollow panels, drain means for draining water which deposits on the panels as a result of condensation of moisture contained in air flowing through the stack, and a sump for collecting the drained water.

In accordance with one embodiment of the present invention, the drain means comprises a drain channel defined between outer surfaces of the lower headers of the nearby hollow panels which face each other.

The drain channel may comprise a recess formed in at least one of the facing outer surfaces of the lower headers of the nearby hollow panels.

A plurality of drain channels may be defined between the facing outer surfaces of the lower headers of the nearby hollow panels.

The above and other objects, features and advantages of the present invention will become apparent from the following detailed description taken with the accompanying drawings.

DESCRIPTION OF THE PREFERRED EMBODIMENT

While the heat exchanger of the present invention is susceptible of numerous physical embodiments, depending upon the environment and requirements of use, a substantial number of the herein shown and described embodiment have been made, tested and used, and all have performed in an eminently satisfactory manner.

Figure 1:
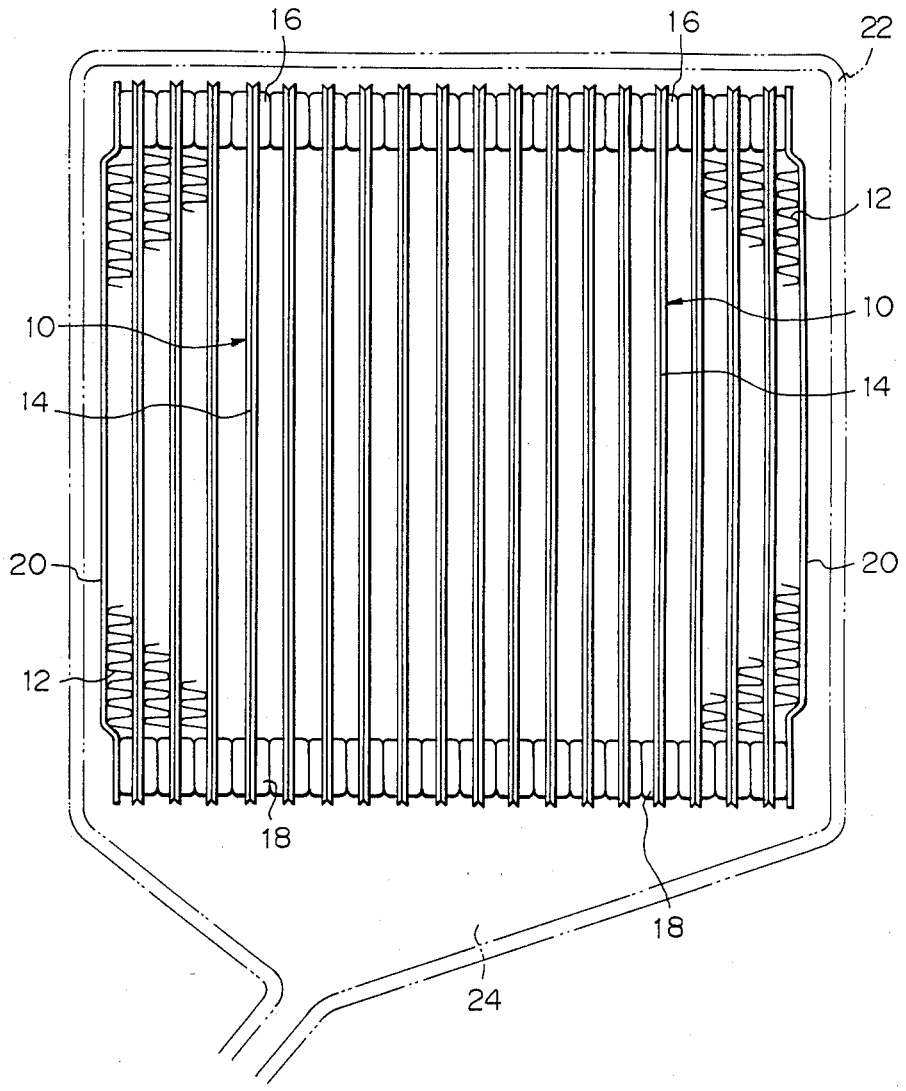
Fig. 1 PRIOR ART
FIG. 1 is a front view of a prior art heat exchanger constructed to serve as a laminate evaporator.

Referring to FIG. 1 of the drawing, a prior art heat exchanger embodied as a laminate evaporator of the type to which the present invention constitutes a novel improvement is shown and comprises a plurality of flat, hollow panels 10 which are stacked together with corrugated plates, or fins, 12 interspersed therebetween. Each hollow panel 10 has a refrigerant passageway 14, a pair of headers 16 facing each other at one end of the panel 10, and a pair of headers 18 facing each other at the other end of the panel 10. End plates 20 for reinforcement are applied to opposite ends of the stack as illustrated. The laminate evaporator assembly is installed in a casing 22 of an air conditioning system such that the headers 16 and the headers 18 are positioned one upon the other. While air flowing through the casing 22 passes through the spacings between the nearby panels, or heat exchanging elements, 10, its temperature is lowered by the refrigerant which is propagating through the passageways 14. As a result, moisture contained in the air condenses to becomes deposited on the panels 10 and corrugates plates 12.

By gravity, the water flows down along the panels 10 and corrugated plates 12 toward the upper surfaces of the lower headers 18. Then, the water falls into a sump 24 below the heat exchanger by way of the side peripheries of the lower headers 18, thereby being drained from the casing 22.

However, since the nearby lower headers 18 are tightly joined together and their upper surfaces extend substantially horizontally, it is quite difficult for the water reached the upper surfaces of the headers 18 to be guided therefrom into the sump 24. It therefore often occurs that the water is frozen in or scattered around the heat exchanger. Another problem inherent in the prior art laminate evaporator is that its headers lack sufficient mechanical strength.

Figure 2:
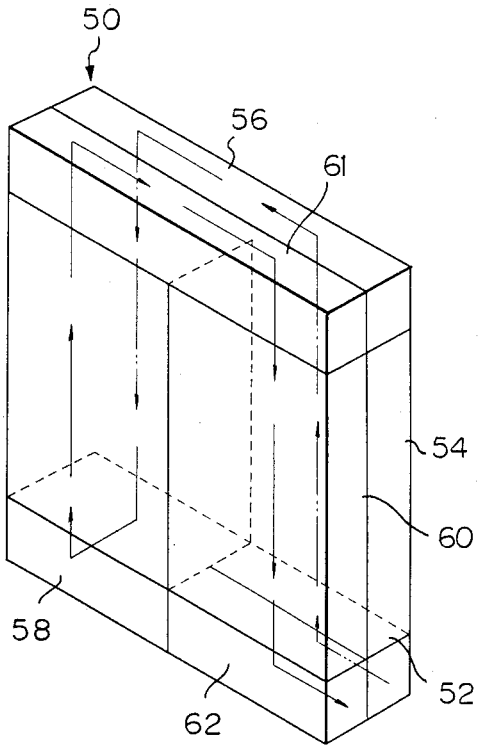
FIG. 2 is a diagrammatic showing of a flow of a refrigerant in a laminate evaporator in accordance with the present invention.

These problems are overcome in accordance with the present invention as illustrated in FIGS. 2–7. A laminate evaporator 50, as schematically shown in FIG. 2, is of a four-pass type which routes a refrigerant through a zig-zag passage. Specifically, a refrigerant entered a group of lower headers 52 adjacent to an inlet (not shown in FIG. 2) is steered upwardly along a rear passageway 54 to enter a group of first intermediate headers 56 which are located in an upper portion of the evaporator 50. Then, it flows down along the rear passageway 54 to enter a group of second intermediate headers 58 which is located in a lower portion of the evaporator 50. Then, rising in a front passageway 60, the refrigerant enters a group of third intermediate headers 61 in an upper portion of the evaporator. Finally, the refrigerant flows down in the front passageway 60 to reach a group of headers 62 adjacent to an outlet (not shown in FIG. 2).

Figure 3:
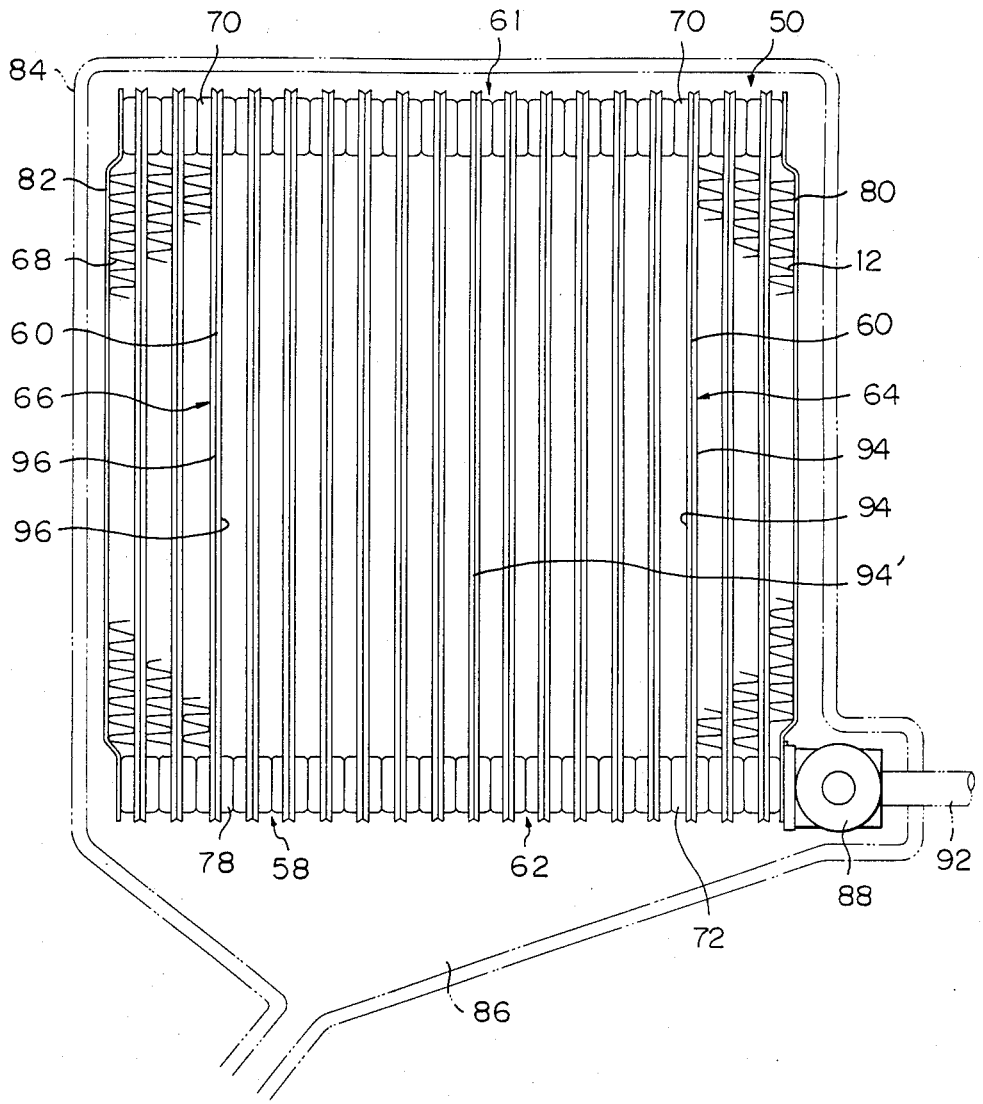
FIG. 3 is a front view of the laminate evaporator shown in FIG. 2.
Figure 4:
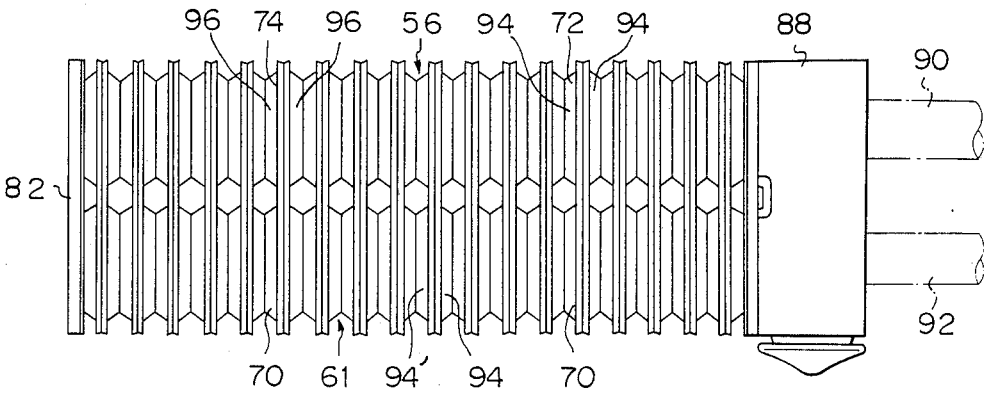
FIG. 4 is a top plan view of the laminate evaporator shown in FIG. 3.
Figure 5:
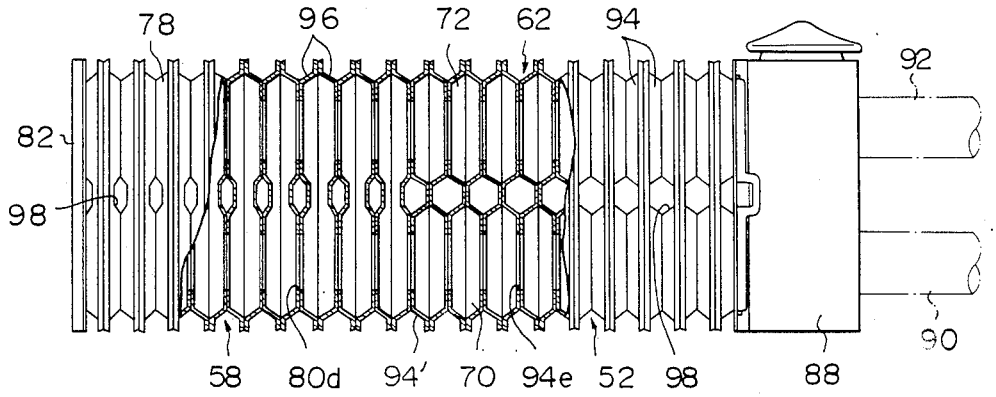
FIG. 5 is a partly sectional bottom view of the laminate evaporator shown in FIG. 3.

As shown in FIG. 3, the evaporator 50 comprises hollow panels 64 and 66 and corrugated plates, or fins, 68 which are alternately stacked together. Each hollow panel 62 has headers 70 and 72 at either side of the passageway 60 and headers 74 and 76 at either side of the passageway 54 (74 and 76 are invisible in FIG. 3). Each of the other hollow panels 66 has headers 70 and 74 identical with those of the panels 64 and a header 78. An end plate 80 is attached to the right end of the stack of panels 64 and 66, and an end plate 82 to the left end of the same. The laminate evaporator 50 is mounted in a casing 84 of an air conditioning system in such a position that the headers 70 and 74 are located above the headers 72, 76 and 78. The reference numeral 86 designates a sump for collecting water.

An inlet and outlet block 88 is mounted on a lower portion of one, 80, of the opposite end plates. Connected to the inlet and outlet block 88 are an inlet conduit 90 (see FIGS. 4 and 5) and an outlet conduit 92. The block 88 provides communication between the inlet header group 52 and the inlet conduit 90 and between the outlet header group 62 and the outlet conduit 92.

In the illustrative embodiment, the panels 64 constitute a right half of the evaporator 50 and the panels 66, a left half of the same. The panels 64 and 66 are somewhat different in configuration as will be described.

Figure 6:
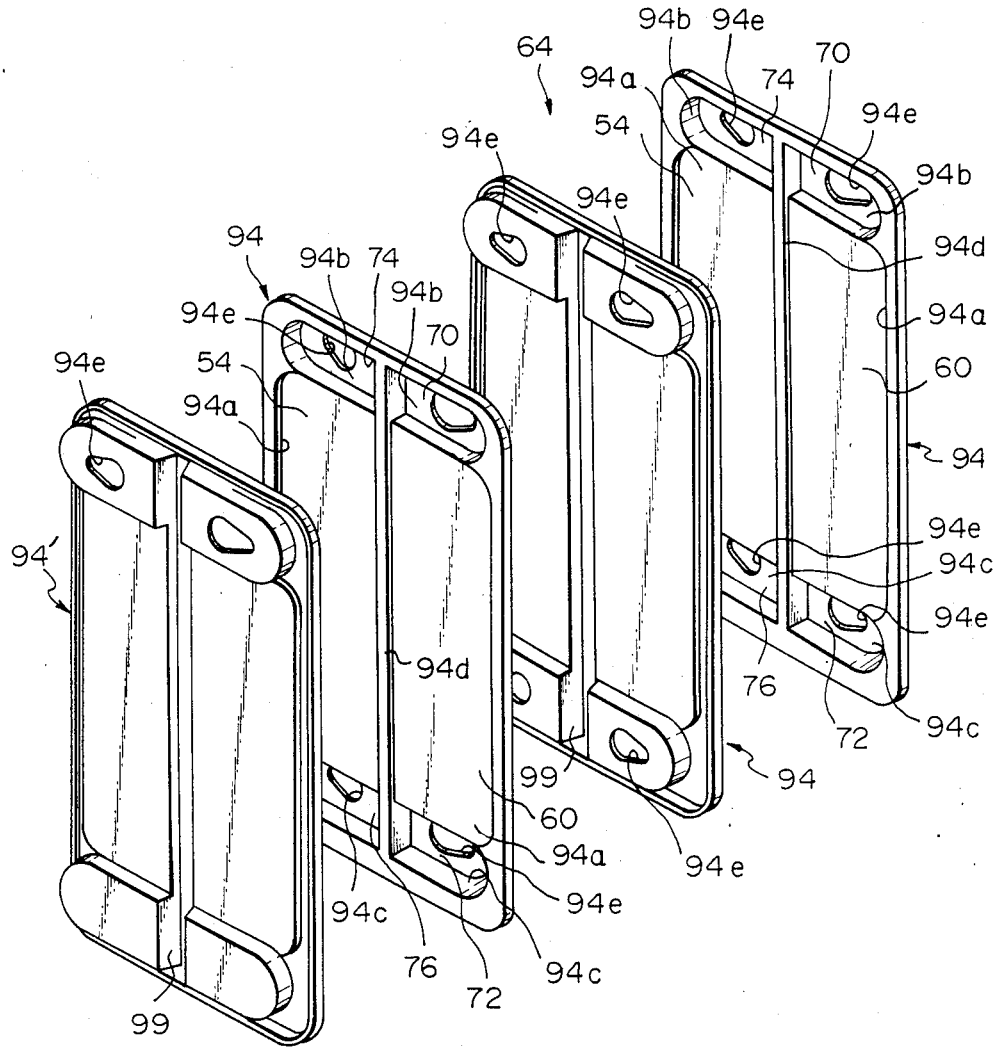
FIGS. 6 and 7 are exploded perspective views of hollow panels included in the evaporator of FIG. 3.

As shown in detail in FIG. 6, each panel 64 in the right half comprises a pair of plates 94. Each plate 94, except for the leftmost one which is designated 94', is provided with a relatively shallow recess **94*a* in a central area thereof and recesses 94*b* and 94*c* at opposite sides of the recess 94*a*, the recesses 94*b* and 94*c* being deeper than the recess 94*a*. A lug 94*d* extends in the lengthwise direction of the plate 94 to serve as a wall which bisects each of the recesses 94*a*, 94*b* and 94*c*. Openings 94*e* are formed through the plate 94 in the two parts of each deep recess 94*b* and 94*c*. The leftmost plate 94' in the right half of the evaporator 50 is identical in configuration with the plates 94 except that it has openings 94*e* formed only in the two parts of the upper deep recess 94*b***.

The plates 94 inclusive of the plate 94' are joined together along their mating surfaces to provide the hollow panels 64. Each of the panels 64 has the passageways 54 and 60 defined in its central area, the headers 70 and 72 communicating to the passageway 60, and the headers 74 and 76 communicating to the passageway 54. The headers 70, 72, 74 and 76 of the panel 64 respectively are communicated with those of the nearby panels 64 by their associated openings **94*e*. The upper front headers 70 serve as a right portion of the third intermediate tank group 61, the headers 74 behind the headers 70 as the first intermediate header group 56, the lower front headers 72 as the outlet header group 62, and the headers 76 behind the headers 72 as the inlet header group 52**.

Figure 7:
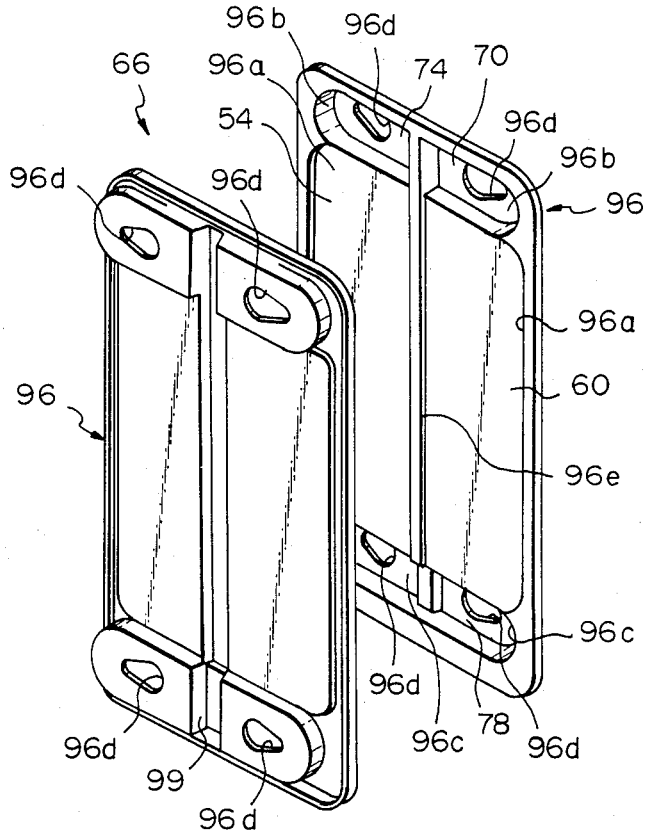

Meanwhile, as shown in FIG. 7, each of the hollow panels 66 in the left half of the evaporator 50 is made up of a pair of plates 96. Each plate 96, like the plate 94 of the right panel 64, is provided with a shallow recess **96*a*, deep recesses 96*b* and 96*c*, openings 96*d*, and an elongate lug or wall 96*e* bisecting the recesses 96*a*, 96*b* and 96*c*. What distinguishes the plate 96 from the plate 94 is the configuration of the lug 96*e*, that is, the height of the lug 96*e* is reduced in the lower deep recess 96*c*. When mated, the plates 96, like the plates 94, define the passageways 54 and 60, and the headers 70 and 74 and the header 78 at opposite sides thereof. Since the lugs 96*e* of the mated plates 96 are individually lowered in their associated lower deep recesses 96*c* as described above, the single lower header 78 is defined by the deep recesses 96*c* with the lugs 96*e* spaced apart from each other. The headers 70, 74 and 78 of each panel 66 are communicated respectively with those of the nearby panels 66 by their associated openings 96*d*. The upper front headers 70 constitute a left portion of the third intermediate hader group 61, the headers 74 behind the headers 70 a left portion of the first intermediate header group 56, and the headers 78 the second intermediate header group 58**.

Drain channels 98 are defined between the lower headers 72, 76 and 78 of the nearby panels 64 and 66. Specifically, at least one of facing outer walls of the nearby panels 52 or 54 is provided with a recess 99 between the lower headers 72 and 74 or between the lower headers 78 so that the facing outer walls define the drain channel 98 therebetween. The upper and lower ends of the respective lower headers are intercommunicated by the drain channels 98. In this particular embodiment, the recesses 99 are formed in both the facing outer walls of the nearby panels 64 or 66 at the step of forming the lugs **94*d* or 96*e***.

In operation, a blower (not shown) is driven to generate a stream of air through the housing 84. While the air flows between the nearby panels 64 and 66, a refrigerant flowing through the panels absorbs heat from the air to thereby lower the temperature thereof. In the meantime, moisture contained in the air is condensed and the resulting water becomes deposited on the panels 64 and 66 as well as on the corrugated plates 68. The water flows down onto the upper ends of the lower headers 72, 76 and 78 is moved therealong by the stream of air until it becomes collected in the sump 86 by way of the sides of the headers 72, 76 and 78 and the drain channels 98.

In summary, it will be seen that the present invention provides a heat exchanger which shortens the distance travelled by condensed water on the tops of lower headers, thereby promoting desirable drainage of the water. This advantage is drived from the provision of a drain channel between the lower headers of each nearby panels which guides the water into a sump therethrough. In addition, recesses formed in the outer walls of headers for defining the drain channels serve to enhance the mechanical strength of the headers.

Various modifications will become possible for those skilled in the art after receiving the teachings of the present disclosure without departing from the scope thereof.

What is claimed is:

1. A multiple pass heat exchanger comprising:

a plurality of hollow panels arranged in a stack with corrugated plates interspersed therebetween and each having a fluid passageway therein and an upper header and a lower header at opposite sides of said fluid passageway, said upper and lower headers being fixed to upper and lower headers of adjacent hollow panels and perforated to communicate respectively with the upper headers and lower headers of adjacent hollow panels;

the fluid passageways and upper and lower headers being interconnected in such a manner that fluid flows therethrough in a multiple pass zig-zag pattern;

drain means for draining water which deposits on said panels as a result of condensation of moisture contained in air flowing through said stack; and a sump for collecting the drained water;

said drain means comprising vertically extending drain channel means defined between outer surfaces of the upper and lower headers of adjacent hollow panels which face each other.

2. A heat exchanger as claimed in claim 1, in which said drain channel means comprises a recess formed in at least one of said facing outer surfaces of the lower headers of the adjacent hollow panels.

3. A heat exchanger as claimed in claim 1, in which said drain channel means comprises a plurality of drain channels defined between the facing outer surfaces of the lower headers of the adjacent hollow panels.

* * * * *